US006101858A

United States Patent [19]

Tseng

[11] Patent Number: 6,101,858

[45] Date of Patent: Aug. 15, 2000

[54] FORMING METHOD FOR FORKED ARTISTIC ALUMINUM OR COPPER ALLOY PIPES

[76] Inventor: Shao-Chien Tseng, No. 130 Sec. 2, Yang-shin Rd., Yang-Mei Taoyuan 326, Taiwan

[21] Appl. No.: 09/357,641

[22] Filed: Jul. 20, 1999

[51] Int. Cl.[7] ..... B21C 23/00

[52] U.S. Cl. ..... 72/256; 72/260; 72/264; 72/370.01; 72/370.04; 72/370.24; 72/466.8

[58] Field of Search ..... 72/256, 260, 264, 72/370.01, 370.03, 370.04, 370.06, 370.07, 370.1, 370.23, 370.24, 465.1, 466.8, 398, 401, 402; 29/557, 558, 423

[56] References Cited

U.S. PATENT DOCUMENTS

| | | | |
|---|---|---|---|
| 3,452,576 | 7/1969 | Wilson | 72/318 |
| 4,512,069 | 4/1985 | Hagemeister | 72/256 |
| 5,660,072 | 8/1997 | Lee | 72/294 |
| 5,784,918 | 7/1998 | Shao-Chien | 72/370.04 |
| 5,813,107 | 9/1998 | Chen | 29/557 |
| 5,941,118 | 8/1999 | Shao-Chien | 72/370.04 |

*Primary Examiner*—Ed Tolan

*Attorney, Agent, or Firm*—Pro-Techtor-International Services

[57] ABSTRACT

A method for forming artistic forked pipes made of aluminum or copper alloy, including the steps of selecting of extruded material, milling for making an extruded pipe, enlarging the bore of a main pipe, and forming to form forked branch pipes. Wherein, an extruded material selected is provided with a plurality of through holes and protruding columns. The through holes are formed to have a main pipe on one end and a plurality of branch pipes on the other end thereof. The material of the protruding columns are milled to distribute on protruding portions on the main pipe, and on protruding portions on the branch pipes for making an extruded pipe. A die core with the corresponding shape of the main pipe has to be fitted in the main pipe hole of the extruded pipe to facilitate operation of exerting pressure onto the protruding portions of the main pipe to enlarge the bore of the main pipe into a desired form. A die core with the corresponding shape of the branch pipes has to be fitted in the branch pipe holes to facilitate operation of exerting pressure onto the protruding portions of the branch pipes to form forked branch pipes having the branch pipes flared. In this way, artistic forked pipes having large strength can be made, and forming technique of the forked artistic pipes of non-ferrous alloy can be improved.

6 Claims, 13 Drawing Sheets

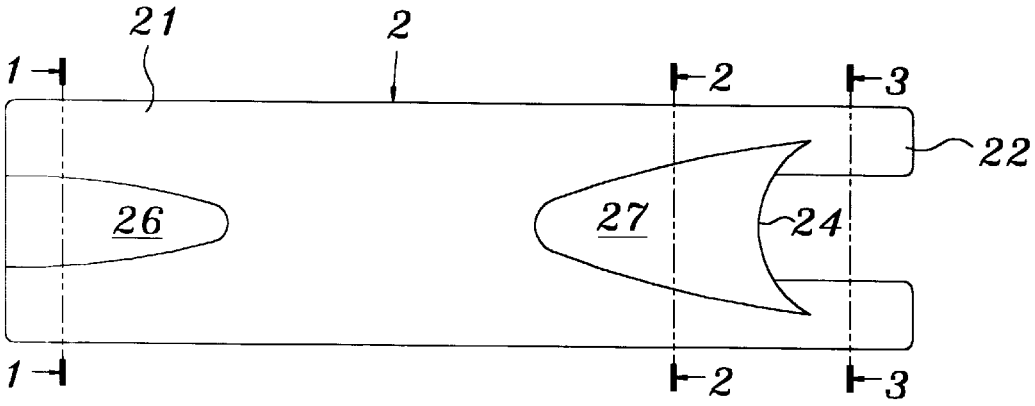
Fig. 2
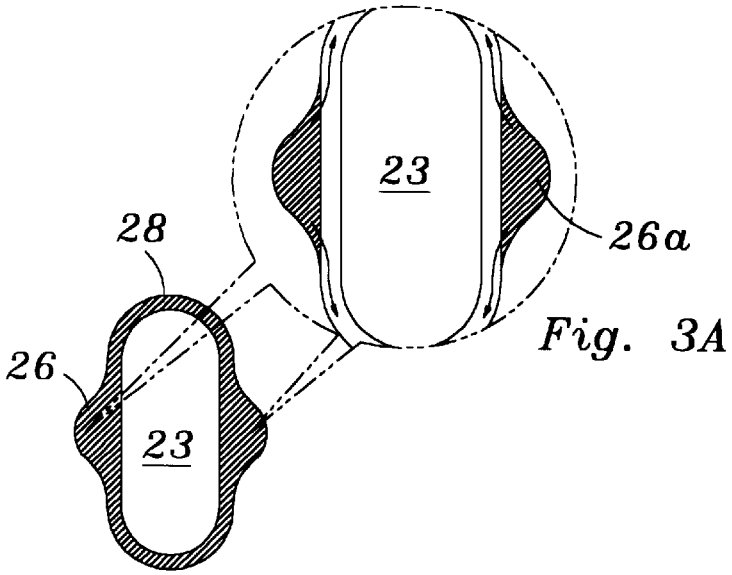
Fig. 3A
Fig. 3

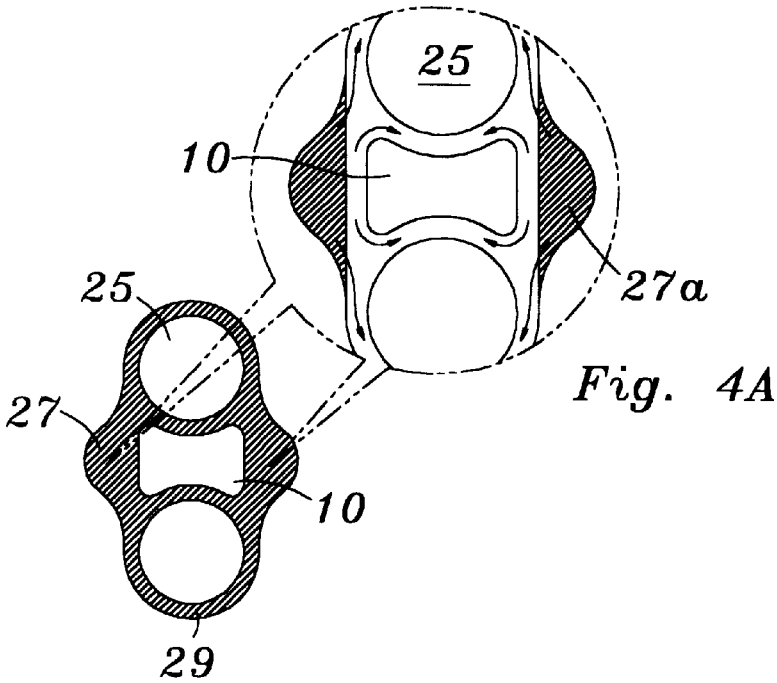
Fig. 4A
Fig. 4
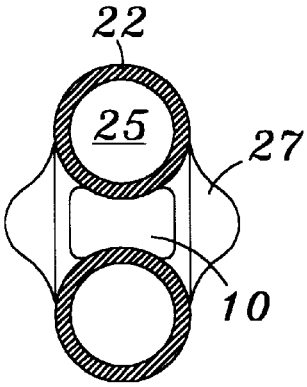
Fig. 5

FORMING METHOD FOR FORKED ARTISTIC ALUMINUM OR COPPER ALLOY PIPES

BACKGROUND OF THE INVENTION

1. Field of the Invention

The present invention is related to a method for forming artistic forked pipes made of aluminum or copper alloy, and especially to the method to manufacture artistic forked pipes from aluminum or copper alloy by means of a forming technique. The pipes can be used as connecting pipes in a kind of furniture, a construction material, a decorative lamp and a sport instrument etc. having higher strength and high-class artistic modeling. Or can be used as pipe connectors requiring light weight and higher strength, and as forked connecting pipes in a metallic artistic article in the form of a tree and the like.

2. Description of the Prior Art

Metallic forked pipes made by conventional founding techniques (such as triple pipes or multiple connectors) are of no concern with the forming technique of the metallic forked pipes by forming in the present invention. This is because that grains structure of castings is too larger and loose although the conventional founding techniques can get artistic contours of forked pipes made of aluminum or copper alloy more easily. Looseness is the main reason of inferior strength of such castings. And the overly coarse castings made by founding techniques can not be used to manufacture artistic forked pipes made of aluminum or copper alloy with large strength and high-class artistic modeling. They are comparatively inferior than the forked pipes made of aluminum or copper alloy by the forming technique of the present invention.

Among the metallic forked pipes made of aluminum or copper alloy in the art, none has used integral forming technique by forming, mostly are made by founding techniques or the technique of welding half-cylinder shaped parts. Such forked pipes made by conventional techniques are not elegant nor adequate in strength and tenacity, thus do not meet the requirement of good style as well as higher strength and good finished. And therefore, are more hardly used in the case which requires better strength for resisting internal or external pressure of pipes. Some of the conventional forked pipes used in the art are made by welding ends of pipes together such as the case of the forked aluminum or copper alloy pipes used in a kind of furniture, a construction material, a decorative lamp and a sport instrument etc. If it is desired to make them to meet the requirement of lowering weight by forming thin pipe walls, aluminum or copper alloy pipes can not meet this requirement though. Because forked aluminum or copper alloy pipes with thin pipe walls made by conventional founding techniques can not afford suffering of concentration of stress that is not allowed as to safety. Therefore, the forked pipes used in a kind of furniture, a construction material, a decorative lamp and a sport instrument etc. in the art, especially in consideration of supporting strength, are hardly to be reduced in their thickness. And are hardly used to make forked pipes with high quality such as low weight and large strength. These problems have been there in the art for a long, long time, however, it is not impossible to overcome, for the forked pipes made by conventional founding techniques are inadequate in strength and tenacity, and do not meet the requirement of good style as well as large strength and good surface finished.

SUMMARY OF THE INVENTION

Therefore, in order to solve the above stated problems, the present invention provides an integral forming method by forming for forked aluminum or copper alloy pipes having the required strength and tenacity.

The present invention provides a forming technique specifically for forming forked artistic aluminum or copper alloy pipes. The technique of the present invention includes novelty in the processes of choosing extruded material and manufacturing by forming forked pipes having the required low weight, large strength and excellent stress scattering effect.

The manufacturing method of the present invention includes choosing extruded material, milling the extruded castings, forming to enlarge the bores of the main pipes of the extrusion in forming and forming to form forked branch pipes etc. These steps of manufacturing are all indispensable and related one from the others; they are coherent.

The present invention will be apparent after reading the detailed description of the preferred embodiment thereof in reference to the accompanying drawings.

BRIEF DESCRIPTION OF THE DRAWINGS

In the drawings:

FIG. 2 is a front view showing an extruded pipe in the present invention after milling and before forming;

FIG. 3 is a sectional schematic view taken from a section line A—A from FIG. 2;

FIG. 3-1 is a sectional view showing protruding portions of the main pipe of FIG. 3;

FIG. 4 is a sectional schematic view taken from a section line B—B from FIG. 2;

FIG. 4-1 is a sectional view showing protruding portions of the branch pipes of FIG. 4;

FIG. 5 is a sectional schematic view taken from a section line C—C from FIG. 2.

FIG. 11-1 is a sectional view taken from a section line D—D in FIG. 11;

DETAILED DESCRIPTION OF THE PREFERRED EMBODIMENT

Figure 1:
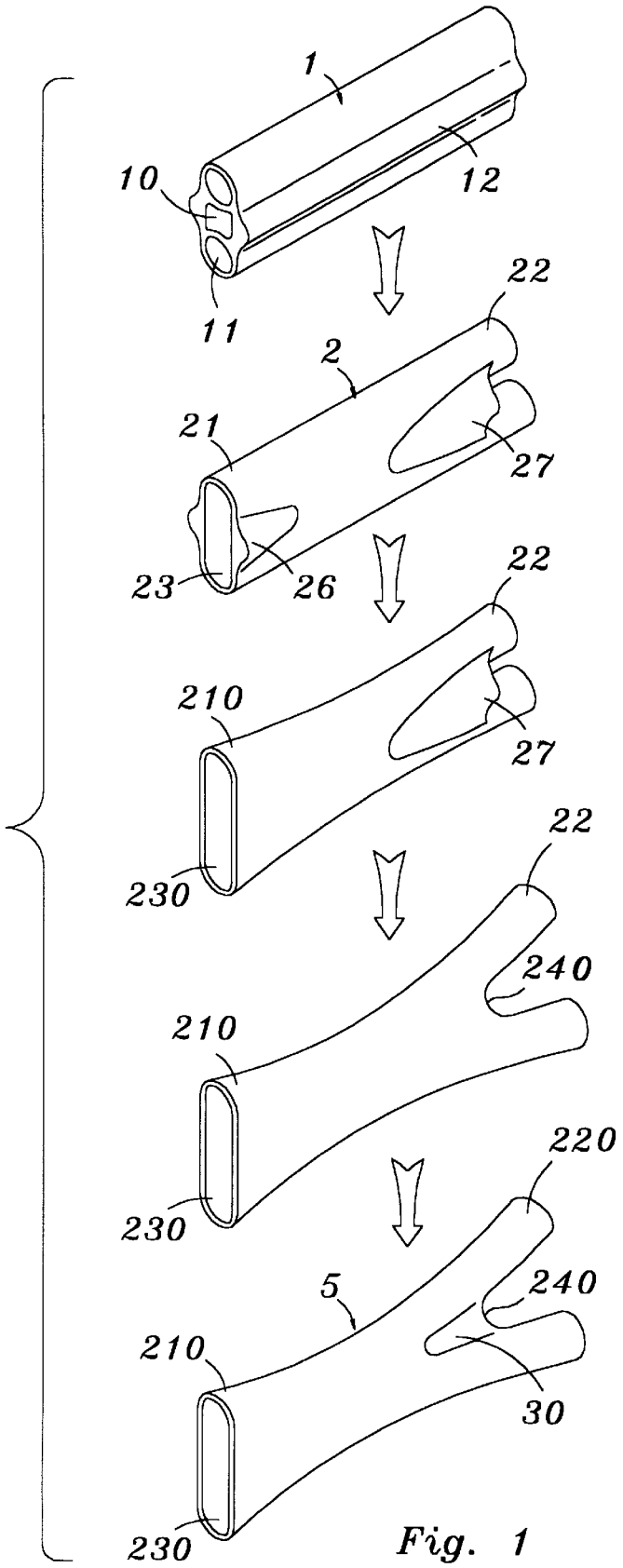
FIG. 1 is a perspective schematic view showing manufacturing of a forked pipe article from extruded material in the present invention.

Referring firstly to FIG. 1, the method for forming artistic forked pipes made of aluminum or copper alloy of the present invention is a forming method to process an extruded material 1 made of aluminum or copper alloy to form an artistic forked pipe 5 with desired large strength.

The technique of the present invention can be used to manufacture a multi-direction artistic forked pipe. The present invention is now described in detail taking manufacturing of a tri-direction forked pipe 5 (as shown in FIG. 1) as an example:

The method of manufacturing of the present invention includes (A) selecting of extruded material; (B) milling for making the extruded pipe; (C) enlarging the bore of a main pipe; and (D) forming to form forked branch pipes. Wherein, in the step of (A) selecting of extruded material 1, an extruded material made of aluminum or copper alloy is selected and is provided with a central hole 10, a plurality of through holes 11 and protruding columns 12. The through holes 11 are formed surrounding the central hole 10; the protruding columns 12 are formed on the wall of the extruded material and between the through holes 11 (as shown in FIG. 1).

Figure 6:
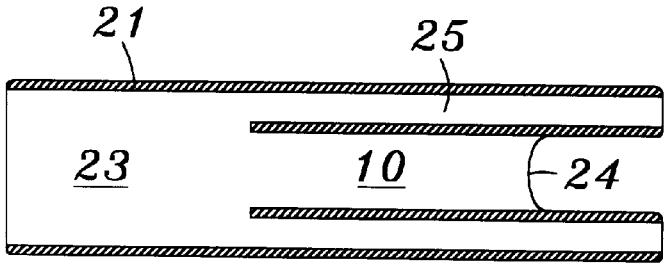
FIG. 6 is a sectional view showing the extruded pipe of the present invention after milling.
Figure 7:
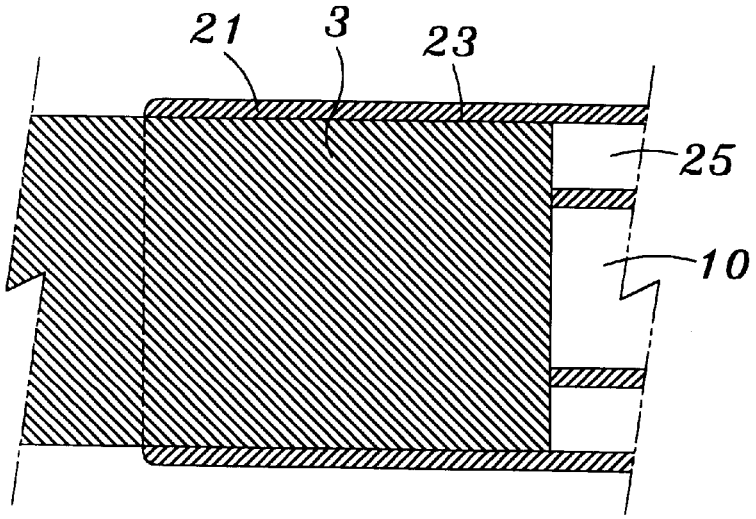
FIG. 7 is a sectional view showing a die core is placed in the main pipe of the present invention.
Figure 8:
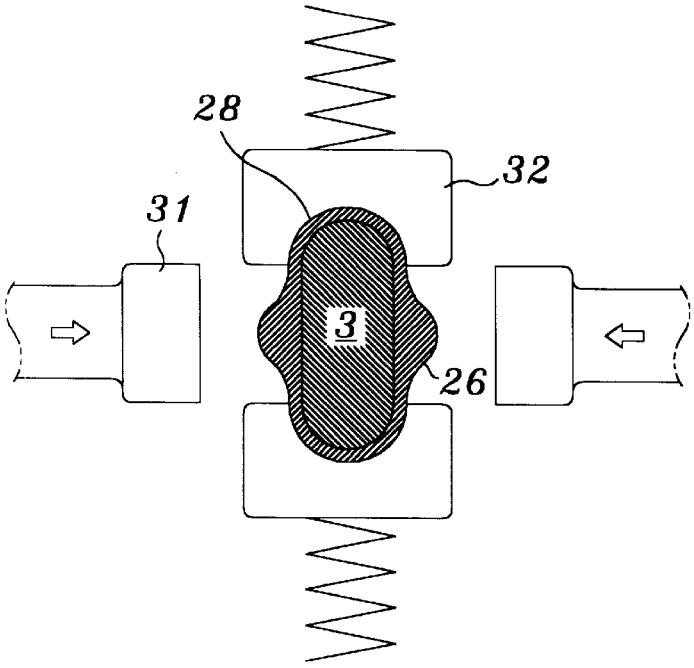
FIG. 8 is a sectional view showing the state before enlarging the bore of a main pipe of the present invention.
Figure 9:
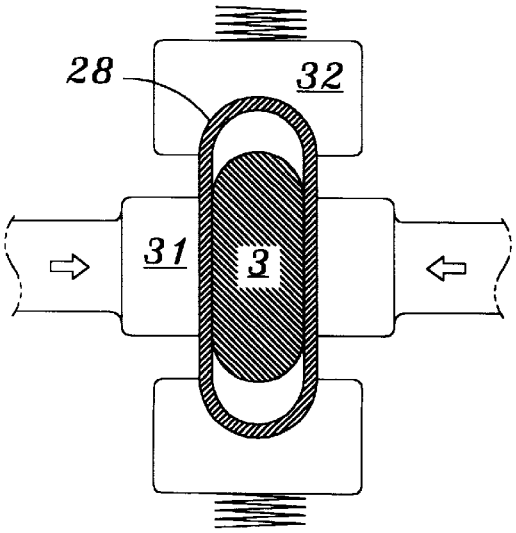
FIG. 9 is a sectional view showing the state after enlarging the bore of a main pipe of the present invention.
Figure 10:
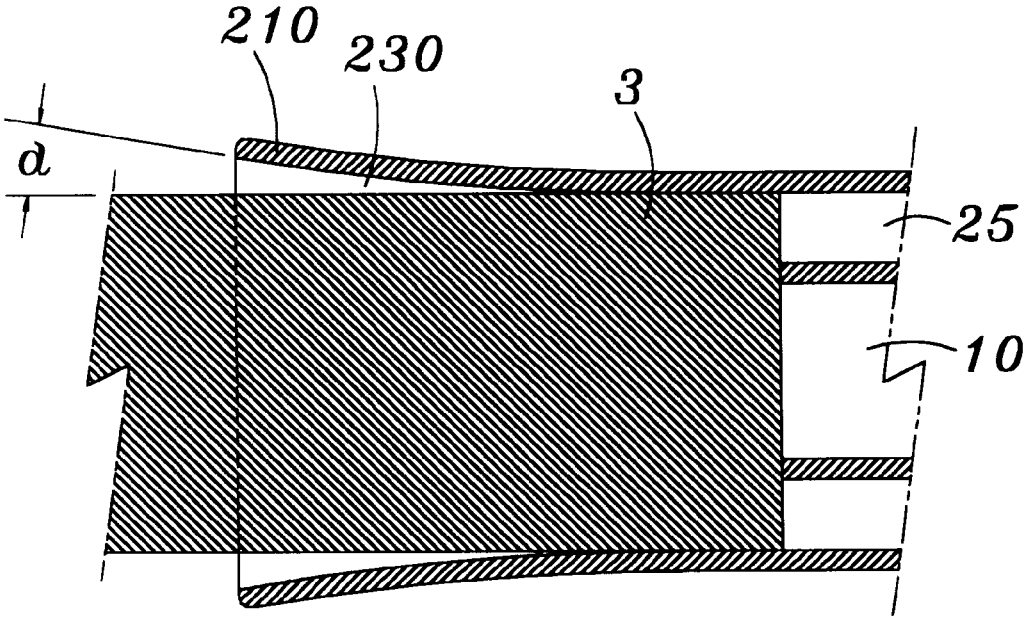
FIG. 10 is a sectional view showing the main pipe of the present invention having its bore enlarged.

In the step of (B) milling for making the extruded pipe 2, a mechanical milling method is used to process the extruded material 1 to get the form having a main pipe 21 and a plurality of branch pipes 22 (as shown in FIGS. 1 and 2). The main pipe 21 is processed to form a straight main pipe hole 23 (also referring to FIG. 6). The branch pipes 22 are milled to get a straddling portion 24 with an are of suitable magnitude (as shown in FIG. 2). The central hole 10 is kept at the position of the straddling portion 24. The central hole 10, the branch pipe holes 25 and the main pipe hole 23 are communicated mutually (as shown in FIG. 6). During the process of milling, the material of the protruding columns 12 on the original extruded material 1 are milled to distribute on the protruding portions 26 on the wall at the two lateral sides of the main pipe 21, and on the protruding portions 27 on the wall at the two lateral sides of the straddling portion 24 (as shown in FIGS. 1 to 5). The protruding portions 26 of the main pipe 21 and the protruding portions 27 of the branch pipes 22 are all made inclined wave forms (as shown in FIG. 1). The total volume 26*a* (as shown in FIG. 3-1) of the protruding portions 26 of the main pipe 21 is provided for latter extruding of material in enlarging the bore of the main pipe. And the total volume 27*a* (as shown in FIG. 4-1) of the protruding portions 27 of the branch pipes 22 is provided for latter extruding of material in enlarging the bores of the branch pipes 22. By the above stated milling process, an extruded pipe 2 integrally comprised of the main pipe 21, the branch pipes 22, the main pipe hole 23, the straddling portion 24, the branch pipes holes 25, the protruding portions 26 of the main pipe 21 and the protruding portions 27 of the branch pipes 22 is made. In the step of (C) enlarging the bore of a main pipe, a die core 3 with the corresponding shape of the main pipe 21 has to be fitted in the main pipe hole 23 of the extruded pipe 2 (as shown in FIG. 7). The die core 3 is made of steel alloy with higher hardness. So that when the main pipe 21 of the extruded pipe 2 made of aluminum or copper alloy is processed for forming in forming, it can provide the effect of supporting the main pipe hole 23 and prevent its wall from collapsing. Thereafter, as shown in FIG. 8, a forming die 31 must be provided for the protruding portions 26 of the main pipe 21 on the extruded pipe 2, and an elastic protecting die 32 must be provided for the elongated ends of the wall 28 of the extruded pipe 2. These are provided to facilitate the operation of bore enlarging. During forming, the forming die 31 exerts pressure onto the protruding portions 26 of the main pipe 21, to form the total volume 26*a* of the protruding portions 26 with inclined wave form (as shown in FIG. 3-1). The material of the protruding portions 26 are gradually and uniformly extruded toward the elongated ends of the wall 28 of the extruded pipe 2 (as shown in FIG. 9). Then the enlarged main pipe 210 is formed to gradually form an enlarged main pipe hole 230 thereof with a flaring angle $\alpha$ (as shown in FIG. 10). Thereafter, the die core 3 is removed to allow removing of the forming die 31 and the elastic protecting die 32. Thus the step of enlarging the bore of the main pipe is completed.

Figure 11:
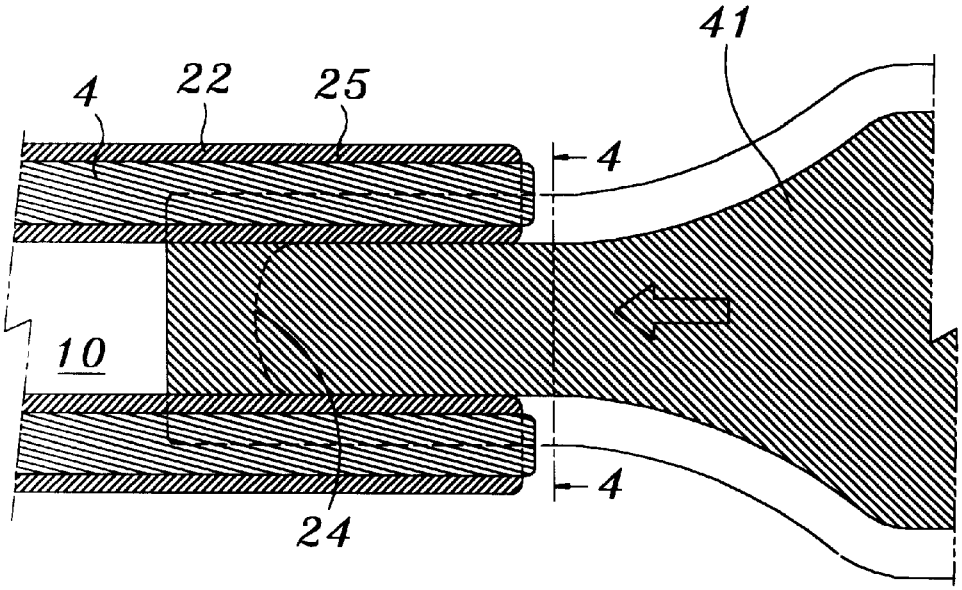
FIG. 11 is a sectional view showing a die core is placed in a branch pipe of the present invention.
Figure 11A:
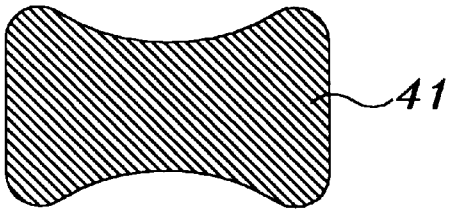
Figure 12:
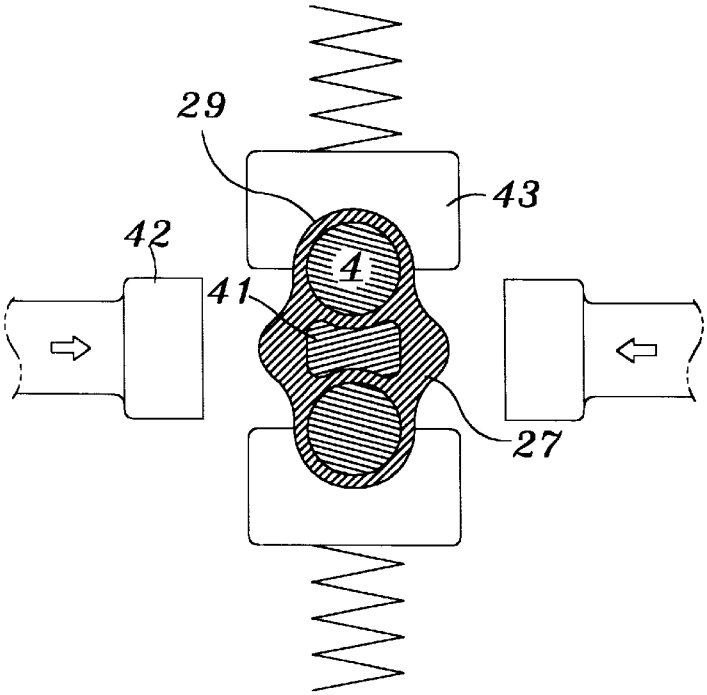
FIG. 12 is a sectional view showing the state before forming to form a forked branch pipe of the present invention.
Figure 13:
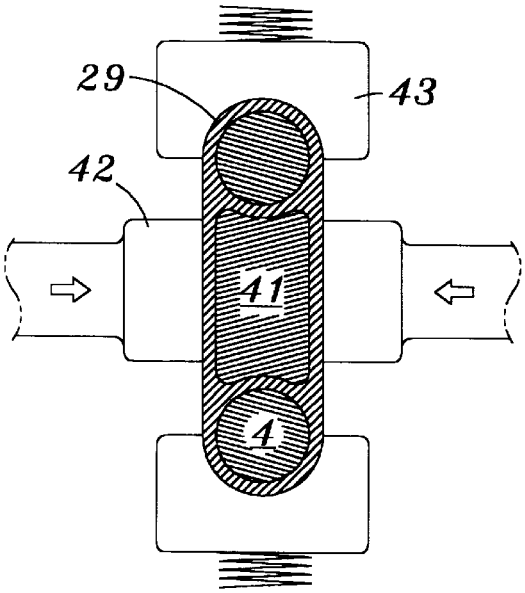
FIG. 13 is a sectional view showing the state after forming to form the forked branch pipe of the present invention.
Figure 14:
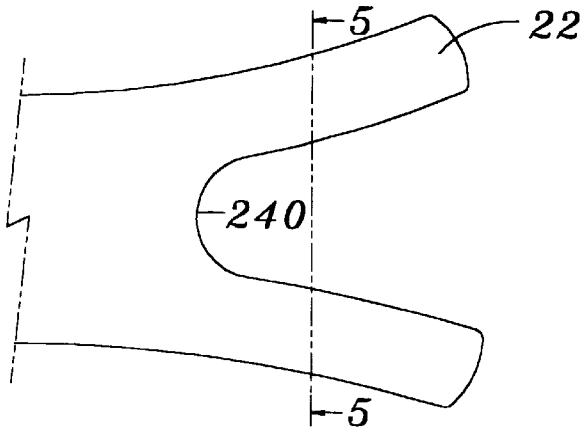
FIG. 14 is a front view of the forked branch pipes of the present invention made.
Figure 15:
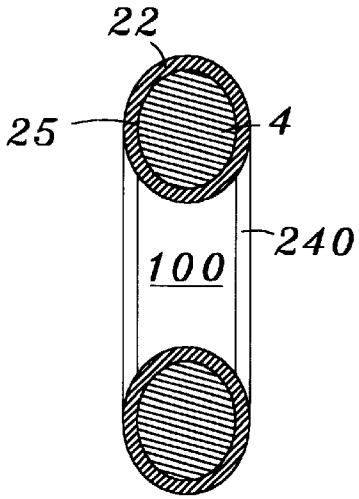
FIG. 15 is a sectional view taken from the section line E—E in FIG. 14.
Figure 16:
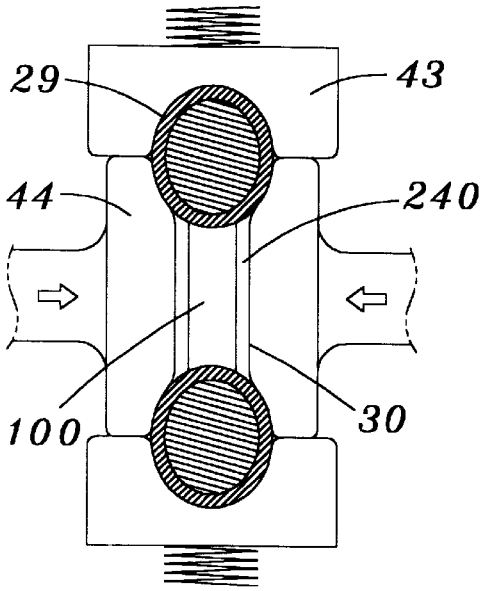
FIG. 16 is a schematic view showing forming for forming a straddling portion in the present invention.

In the step of (D) forming to form forked branch pipes, a die core 4 with the corresponding shape of the branch pipes 22 is provided in the holes 25 of the latter of the extruded pipe 2. And a middle die core 41 (as shown in FIG. 11) is fitted in the central hole 10 of the straddling portion 24. The middle die core 41 is contoured to have a wall section corresponding to the shape of the central hole 10 (as shown in FIG. 11-1). But the lateral wall surfaces of the middle die core 41 are made arciform and flared (as shown in FIG. 11). The die core 4 for the branch pipes 22 is made of alloy of low melting point, capable of supporting the branch pipes 22 during forming operation for the forked shapes of the branch pipes 22 and preventing them from collapsing and deformation. And after forming by the forming operation, by the nature that its melting point is lower than that of aluminum or copper alloy, the die core 4 for the branch pipes 22 can be removed easily from the branch pipes 22 after their shrinkage by melting. The middle die core 41 is made of steel alloy of higher hardness. And is capable of supporting the central hole 10 and enlarging the branch pipes 22 at the two lateral sides thereof to gradually render them to form flared forked shapes during forming operation of the branch pipes 22 on the extruded pipe 2 made of aluminum or copper alloy. Then a forming die 42 must be provided for the protruding portions 27 of the branch pipes 22. And an elastic protecting die 43 must be provided for the elongated ends of the walls 29 of the branch pipes 22 (as shown in FIG. 12) to facilitate the operation of forming forked branch pipes. During the forming operation, the forming die 42 exerts pressure onto the protruding portions 27 of the branch pipes 22, to form the total volume 27*a* of the protruding portions 27 with inclined wave form (as shown in FIG. 4-1). The material of the protruding portions 27 are gradually and uniformly extruded toward the elongated ends of the walls 29 of the branch pipes 22 (as shown in FIG. 13). At the time when the forming die 42 exerts pressure for forming (as shown in FIG. 11), the branch pipes 22 are formed gradually a straddling portion 240 on a forked portion (as shown in FIGS. 1, 14 and 15). Then the middle die core 41 is removed in the first place to present a central hole 100 in the straddling portion 240 of the forked portion (as shown in FIG. 15). A forming pressing die 44 is used to process the straddling portion 240 in forming by forming (as shown in FIG. 16). Therefore, the material on the wall of the straddling portion 240 can form a recessed portion 30 (as shown in FIG. 17) to thereby complete the operation of forming in forming the forked branch pipes.

In the operation of forming to enlarge the branch pipes, the total volume 27*a* of the protruding portions 27 and the inclined wave form thereof are the important factors in determining the size of the flared forked shape of the branch pipes 22. In short, the protruding portions 27 are provided as the material for elongation of the pipe walls of the branch pipes 22 during enlarging of the forked shape.

Figure 17:
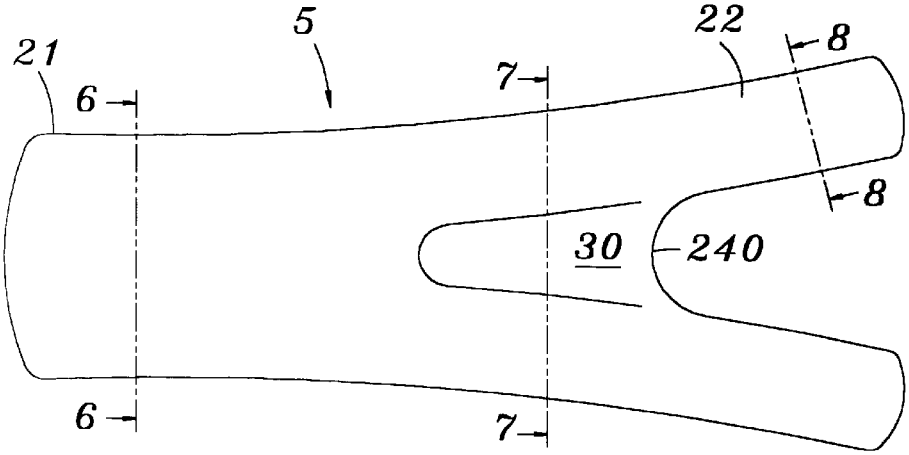
FIG. 17 is a front view of the forked pipe article of the present invention made.
Figure 18:
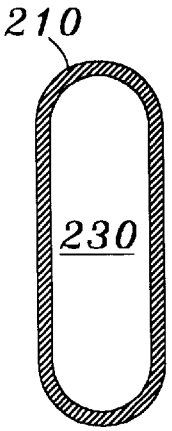
FIG. 18 is a sectional view taken from a section line F—F in FIG. 17.
Figure 19:
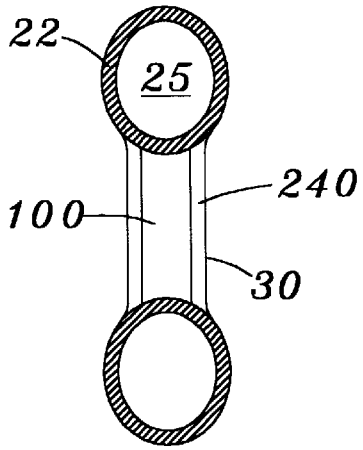
FIG. 19 is a sectional view taken from a section line G—G in FIG. 17.
Figure 20:
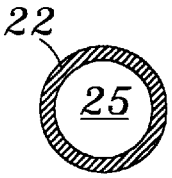
FIG. 20 is a sectional view taken from a section line H—H in FIG. 17.

By the above stated technique, the method of the present invention can be completed, and a forked pipe article 5 having large strength and high-class artistic modeling made of aluminum or copper alloy can be obtained (as shown in FIG. 17). The shaped main pipe 210 and the main pipe hole 230 have the shapes of a tapered pipe and its pipe hole (also referring to FIG. 18). The straddling portion 240, the end of the central hole 100 and the pipe body at the recessed portion 30 all together form a flared fork with a slight recessed middle portion (also referring to FIG. 19). While the branch pipes 22 and the holes 25 thereof are all in the form of round pipes and round pipe bores respectively (also referring to FIG. 20). In this way, the forked pipe article 5 being shaped has large strength for forming and can have the curves of an artistic article.

Figure 21:
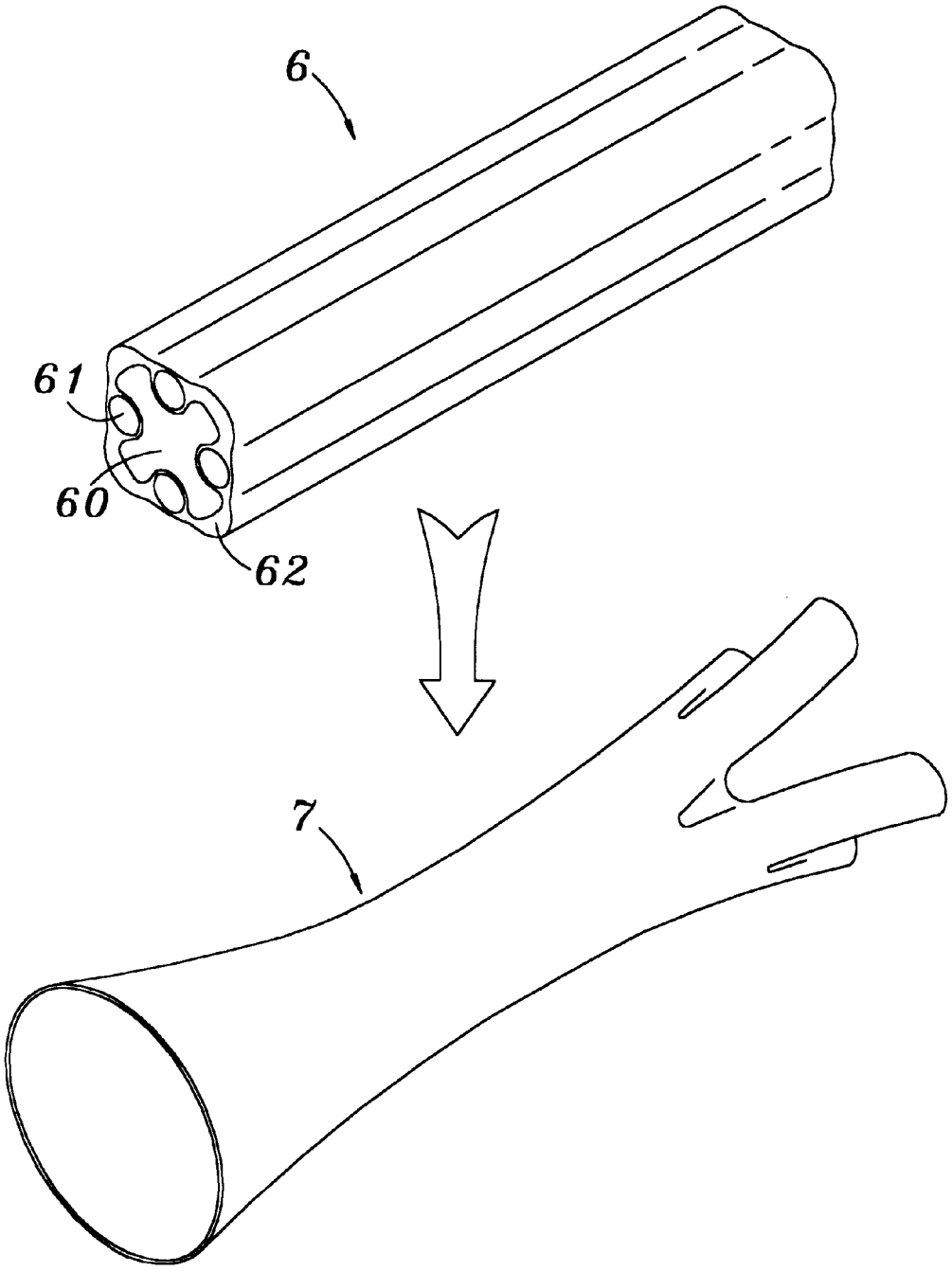
FIG. 21 is a perspective schematic view showing choosing another extruded material for manufacturing a forked multiple pipe article by the present invention.
Figure 22:
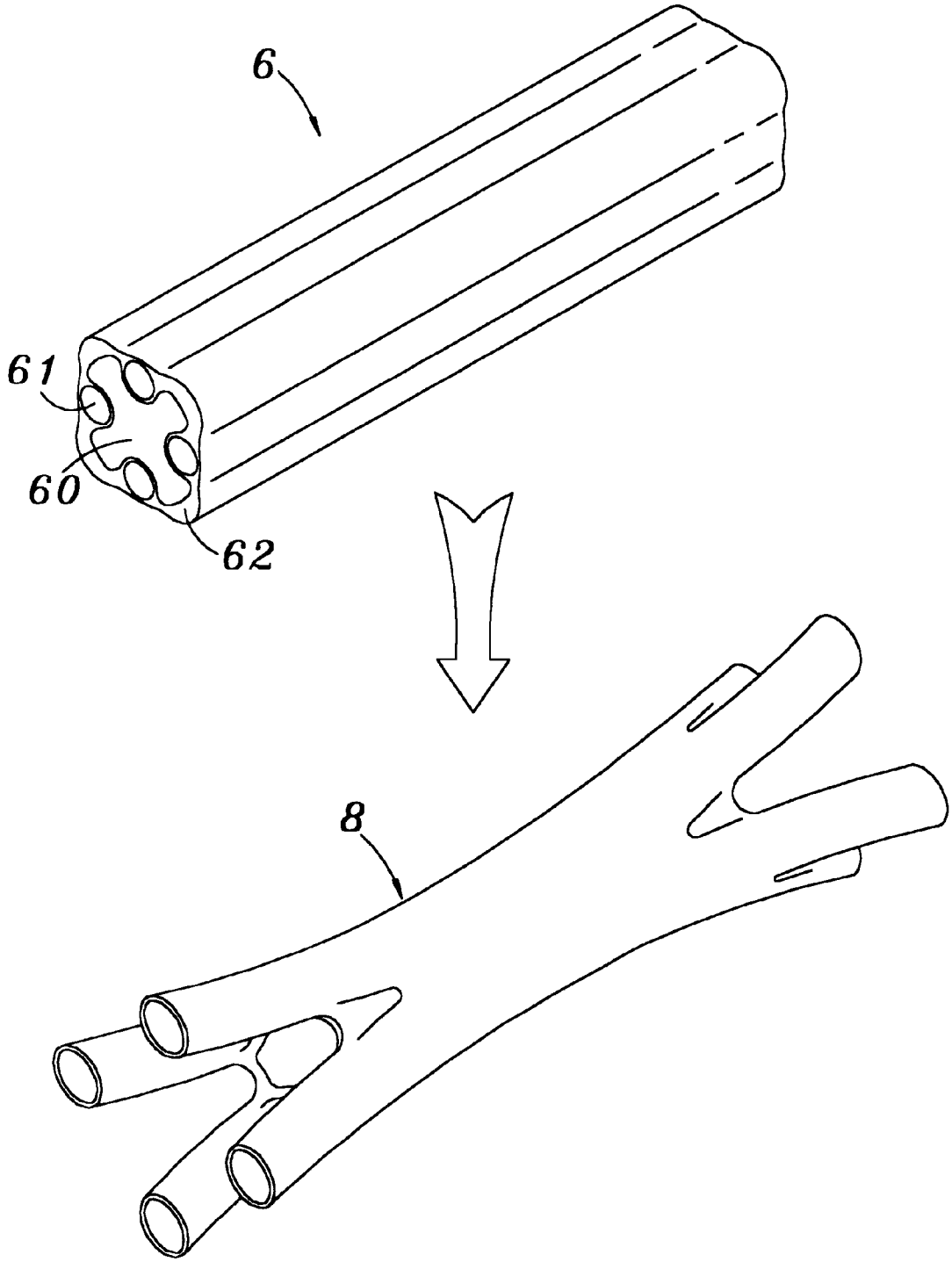
FIG. 22 is a perspective schematic view showing choosing another extruded material for manufacturing a forked multiple pipe article by the present invention having multiple pipes on both ends thereof.

By the method of the present invention, a multi-direction forked pipe article 7 can also be completed. Taking the embodiment shown in FIG. 21 as an example, when in the step of (A) selecting of extruded material, the extruded material 6 with a single central hole 60, multiple through holes 61 and multiple protruding portions 62 is selected. The through holes 61 surround the central hole 60, the protruding portions 62 are formed between every two through holes 61. With this extruded material 6 and by the above stated steps of (B) milling for making the extruded pipe, (C) enlarging the bore of a main pipe and (D) forming to form forked branch pipes, a multi-direction forked pipe 7 can be made. And with the same or similar one of the above stated extruded material 6 and by the above stated method of the present invention, a multidirection forked pipe 8 having a fork shape on both ends thereof can be made (as shown in FIG. 22).

A forked pipe article made by the method of the present invention can be used as a connecting pipe in a construction material, a kind of furniture, a lamp and a sporting article having high-class artistic modeling. And can also be used as a forked connecting pipe in a metallic artistic work having the shape of branches of a tree. Therefore, the main pipe hole and the branch pipe holes thereof are used to connect by insertion or screwing with other pipes. Thus the article made has the advantages of light weighted forming-formed articles made of aluminum or copper alloy and the advantages of higher strength and stress scattering capability in preventing from stress concentration.

Having thus described the technical process of my invention having high industrial value in contribution to making delicacy for forked pipe articles having large strength and made of aluminum or copper alloy, what I claim as new and desire to be secured by Letters Patent of the United States are:

1. A method for forming artistic forked pipes made of aluminum or copper alloy, said method includes the steps of:

(A) selecting an extruded aluminum or copper alloy blank, said extruded blank is provided with a central hole, a plurality of through holes. and a plurality of protruding columns; said through holes are formed surrounding said central hole, said protruding columns are formed on an outer wall of said extruded material, said protruding columns are positioned to lie between said through holes;

(B) milling said extruded blank with a mechanical milling process to form a workpiece having a main pipe and a plurality of branch pipes, said main pipe and each of said branch pipes are in communication with each other, said main pipe is processed to form a straight main pipe hole, said branch pipes are milled so as to form a straddling portion with an arc, the material of said protruding columns on said extruded blank are milled to form protruding portions at the two lateral sides of said main pipe, and to form protruding portions at the two lateral sides of said straddling portion;

(C) enlarging the bore of said main pipe by using a first die core with a shape corresponding to that of said main pipe, said first die core is fitted in a main pipe hole of said extruded pipe, a forming die is provided for said protruding portions of said main pipe, and an elastic protecting die is provided for elongated ends of a wall of said extruded pipe, said forming die exerts pressure onto said protruding portions of said main pipe, the material of said protruding portions are gradually and uniformly extruded toward said elongated ends of said wall of the extruded pipe, then said main pipe is formed to gradually form an enlarged main pipe hole;

(D) forming forked branch pipes by using a second die core with a shape corresponding to that of said branch pipes, said second die core is provided in said branch pipe holes of said extruded pipe, and a middle die core is fitted in said central hole of said straddling portion, a forming die is provided for said protruding portions of said branch pipes, and an elastic protecting die is provided for elongated ends of walls of said branch pipes; said forming die exerts pressure onto said protruding portions of said branch pipes, the material of said protruding portions are gradually and uniformly extruded toward said elongated ends of said walls of said branch pipes, said branch pipes are gradually formed with a straddling portion on a forked portion including said branch pipes, a forming pressing die is used to process said straddling portion by forming so that the material on a wall of said straddling portion forms a recessed portion to thereby complete the operation of forming said forked branch pipes.

2. The method for forming artistic forked pipes made of aluminum or copper alloy as claimed in claim 1, wherein, a total volume of said protruding portions of said main pipe is provided for later extruding of material in enlarging the bore of said main pipe.

3. The method for forming artistic forked pipes made of aluminum or copper alloy as claimed in claim 1, wherein, the total volume of said protruding portions of said branch pipes is provided for later extruding of material in enlarging the bores of said branch pipes.

4. The method for forming artistic forked pipes made of aluminum or copper alloy as claimed in claim 1, wherein, said first die core of said main pipe and said middle die core are made of a steel alloy with high hardness.

5. The method for forming artistic forked pipes made of aluminum or copper alloy as claimed in claim 1, wherein, said middle die core is contoured to have a wall section corresponding to the shape of said central hole, but lateral wall surfaces of said middle die core are made arciform and flared.

6. The method for forming artistic forked pipes made of aluminum or copper alloy as claimed in claim 1, wherein, said die core for said branch pipes is made of alloy having a melting point lower than that of aluminum or copper alloy.

* * * * *